United States Patent [19]

Petrovich

[11] 4,159,943

[45] Jul. 3, 1979

[54] FROTH FLOTATION OF ORES USING HYDROCARBYL BICARBONATES

[76] Inventor: Vojislav Petrovich, 1935 W. Schiller St., Chicago, Ill. 60622

[21] Appl. No.: 878,385

[22] Filed: Feb. 16, 1978

[51] Int. Cl.[2] ..... B03D 1/02

[52] U.S. Cl. ..... 209/166

[58] Field of Search ..... 209/166, 167; 252/61; 260/463 D

[56] References Cited

U.S. PATENT DOCUMENTS

| | | | |
|---|---|---|---|
| 1,370,843 | 3/1921 | Sayre | 252/61 X |
| 1,398,990 | 12/1921 | Wilkinson | 252/61 X |
| 1,510,150 | 9/1924 | Martin | 252/61 X |
| 1,711,087 | 4/1929 | Donahue | 252/61 X |
| 1,976,203 | 10/1934 | Trotter | 209/167 X |
| 1,995,915 | 3/1935 | Burdick | 252/61 X |
| 2,011,176 | 8/1935 | Keller | 252/61 X |

OTHER PUBLICATIONS

Mackh's Chem. Dictionary, Third Edition, 1944, pp. 569, 225, 482, 208, 450, 511.

*Primary Examiner*—Robert Halper

[57] ABSTRACT

A froth flotation method for recovering of mineral values of earth alkaline metal minerals such as of magnesium, calcium, strontium, barium; base metal minerals such as of copper, silver, lead, zinc; heavy metal minerals such as of nickel, cobalt, iron, and manganese by froth flotation method which comprises; adding to a water suspension of finely divided ore at a pH from 6 to 8, an amount of alkyl, alkylaryl, aralkyl, aryl, cyclo, cycloalkyl bicarbonate as promoter-collector; aerating the pulp of mineral slurry and recovering the floated mineral from the suspension.

3 Claims, No Drawings

FROTH FLOTATION OF ORES USING HYDROCARBYL BICARBONATES

BACKGROUND

The present invention relates to a novel class of flotation agents, namely the hydrocarbyl bicarbonates as flotation reagents in the separation of earth alkaline metal minerals, such as of magnesium, calcium, strontium, and barium, as well as base metal minerals such as of copper, silver, lead, and zinc, also heavy metal minerals such as of nickel, cobalt, iron, and manganese.

Flotation is a process of treating a mineral slurry of a pulverulent ore suspended in water; an ore in which the mineral of a certain metal which is to be recovered is substantially liberated from the gangue minerals, such as clay, silica, silicates and the like; a process in which certain chemicals are added to the pulp of mineral slurry, and by introducing the air by blowing or agitation, because of which a froth mass containing bubbles is produced; said bubbles may develop only by certain chemicals, commonly known as frothers or collector-frothers, to which adhere the finely divided mineral particles of mineral to be recovered, and leaving suspended (unfrothed) other solid components of the ore. Thus, flotation is based on the principle that introducing chemical and the air into water containing solid particles of different materials suspended therein which causes adherence of air to certain suspended solid and to make the particles having air bubbles thus adhered thereto lighter than the water. Accordingly, they rise to the top of the water to form a froth, which as such is skimmed off.

Various flotation agents have been admixed with the suspension to improve the frothing as well as the collecting process. Such added agents are classed according to the function to be performed: frothers which impart the property of forming a stable froth, e.g., natural oils such as pine oil and eucaliptus oil, or industrial products such as cresylic acid, higher alcohols, ethoxylated aliphatic and aromatic hydrocarbons and the like products; collectors such as xanthates, thiocarbamates, cresyl thiophosphates and the like. Besides the enumerated frothers and collectors, certain chemical compounds are added to the mineral slurry to enhance the phenomena of flotation and advantageously influence the separation of desired mineral, or depress the undesired components of the ore. Thus, emulsifiers, dispersants, depressants, and modifiers are added.

It is important to bear in mind that additives of the above type are selected for use according to the nature of the ore, the mineral sought to be recovered, and the other additaments which are to be used in combination therewith.

An understanding of the phenomena which makes flotation a particularly valuable industrial operation is not essential to the practice of the present invention. They appear, however, to be largely associated with selective affinity of the surface of particulated solids suspended in water containing entrapped air, for the water on one hand, the air on the other.

Flotation principle is applied in a number of mineral separation processes among which the selective separation of such minerals as sulfide copper minerals, sulfide lead mineral, sulfide zinc mineral, sulfide molybdenum mineral and other sulfides from sulfide iron minerals. The present invention concerns a novel class of compounds namely the alkyl, alkylaryl, aralkyl, aryl, cyclo, and cycloalkyl bicarbonates. These compounds can be employed as collecting agents in flotation process. With some of these compounds better recoveries are realised and with others, improved selectivity is achieved. Certain of these compounds produce improvements in both aspects not only with some of the preceding sulfides but with certain oxide minerals also.

SUMMARY OF THE INVENTION

The present invention concerns novel collecting compounds corresponding to the formula

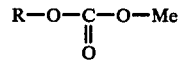

and

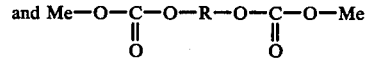

wherein R represents a hydrocarbyl group, or heterocarbyl group, R represents an alkyl or alkenyl containing up to 12 carbon atoms, R represents tolyl, xylyl, phenyl, benzyl, hexamethylbenzyl, mesitylene, cresetyl, acetophenyl, ethoxybenzylmethyl, ethoxybenzylhexamethyl, ethoxyphenyl, acetylphenyl, cyclopropyl, cyclopropylol, cyclohexyl, cyclohexylol, cycloacetyl, cycloacetylbutylol, dipropylphenyl, dipropoxyphenyl, dicyclohexyl, dipropylcyclohexyl, dipropoxycyclohexyl, wherein said alkylaryl, aralkyl, aryl, or cycloalkyl groups and structures contain up to 12 carbon atoms; said hydrocarbyl groups or structures may contain a heteroatom substituted in the hydrocarbon chain or structure, and is selected from the group consisting of an —O— oxygen, or a neutral carbonic group

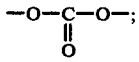

and Me represents an alkali metal or ammonia.

The free, i.e., unsubstituted one valent carbonic acid radical in a compound of the above exposed composition acts as a functional group, i.e., as collector for earth alkaline metal minerals, such as of magnesium, calcium, strontium, barium; base metal minerals, such as of copper, silver, lead, zinc; heavy metal minerals, such as of nickel, cobalt, iron, and managenese.

The bicarbonate radical of said condensation products acting as collector for the enumerated metallic and nonmetallic minerals, is the functional group of said compounds. The hydrocarbyl bicarbonate collectors of this invention can be prepared by the reaction of monochlorinated hydrocarbon of alkyl, alkylaryl, aralkyl, aryl, cyclo, or cycloalkyl with anhydrous soda ash in a neutral dry solvent at a moderate temperature. The disclosed condensation process is well known to those skilled in the art of chemistry, and is not the subject of this invention, so no specific description is needed to enable a person skilled in the art of chemistry to make the same.

This invention relates to a new and improved froth flotation method for recovering of minerals by means of alkyl or aryl, alkylaryl, aralkyl, cyclo, and cycloalkyl substituted bicarbonate as a new class of froth flotation reagents with promoting, collecting, and frothing properties in a slightly acid or a slightly alkaline pulp of mineral slurry. The best results may be obtained in a neutral pulp of mineral slurry.

The present invention points to a variety of compounds of nearly identical properties and behavior in froth flotation process of my invention, serving as collectors for earth alkaline, base, and certain heavy metal minerals said hereinbefore. The feasibility of furnishing pure magnesite and brucite to the refractory industry from poor, silicified orebodies is a big advantage of this invention, because as yet no pure and high grade concentrates of magnesite or brucite can be obtained by ordinary methods and agents as yet known and practiced. Many vast magnesite and brucite orebodies are out of reach of the metallurgy. Furthermore, oxide lead and zinc ores may be very successfully recovered by hydrocarbyl bicarbonates of this invention. Moreover, sulfide lead and zinc ores are a promising field of the application because the hydrocarbyl bicarbonates are harmless and effective collectors of lead and zinc sulfide ores. The flotation plants which are now full of aerofloat and xanthate odor will be odorless if hydrocarbyl bicarbonate will be applied. The copper-molybdenum ore, the most frequently occuring specy of molybdenum ore, which occasionally may contain wolframate and vanadate minerals, may be very successfully beneficiated furnishing a pure copper concentrate, leaving molybdenite, wolframite in tailing which minerals can be recovered by another suitable process, or processes. Nickel and cobalt sulfide and oxide ores are successfully recovered from various matrixes represented in the ore. Iron and manganese minerals may be recovered successfully from silica matrixes and such silicates which does not contain iron; but rhodonite, manganese silicate, as well as rhodochrosite, manganese carbonate, and various manganese oxide ores may be successfully recovered from silica and silicate matrixes.

The special feature of froth flotation procedure of copper, zinc, pyrite ores by means of hydrocarbyl bicarbonates instead by xanthates is distinguished by the elimination of activation of zinc mineral with copper sulfate and the flotation in a highly alkaline pulp of mineral slurry in the zinc circuit. In such cases the copper mineral is floated with hydrocarbyl bicarbonate in the presence of cyanide, which depress zinc mineral and pyrite mineral. After copper mineral is floated out in a neutral pulp of mineral slurry, iron trichloride or iron sulfate is added to block the cyanide and dereagentize zinc mineral, which will float with an added amount of hydrocarbyl bicarbonate; pyrite will be blocked and depressed because coated with something kindred to ferryferrocyanide.

The flotation of manganese minerals does not represent any difficulty worth to discuss. If not mixed with other minerals of heavy or base metals, the flotation is simple and direct with hydrocarbyl bicarbonate.

The reagent cost with application of alkyl or aryl substituted bicarbonates as flotation reagents is a low one, appoximately half as high as the reagent cost with the application of potassium alkyl xanthates as flotation reagents. Besides a frother is also eliminated, all of which represent an important saving.

The flowsheets with the application of alkyl or aryl substituted bicarbonates are shorter and more direct, which is a big technical advantage.

Moreover, as will be seen from what follows, the time of flotation required is comparatively short as compared to conventional flotation circuits with xanthates and the like reagents. This not only means an appreciable saving in capital cost but also is an important reduction in operating costs.

The froth flotation process of this invention is best accomplished in a neutral pulp of mineral slurry, or in a slightly acid or slightly alkaline pulp of mineral slurry. The pH of the flotation circuit is operative from 6 to 8. In spite of the wide range of the pH value which may occur in practicing the flotation, the standard pH control technics are substantially unaffected in this process of my invention, and should be applied where and when needed in connection with the character of the particular ore treated and the ore pretreatment during the milling stage. In any case, in slightly alkaline, neutral, or slightly acid pulp of mineral slurry there ensues the formation of the hydrophobic complex of alkyl or aryl bicarbonate of magnesium, calcium, strontium, barium, copper, silver, lead, zinc, nickel, cobalt, iron, and manganese minerals respectively. The characteristics of the process of this invention is the persistence of the promotion.

Thus, one of the objects of the present invention is to provide a simple expedient and inexpensive method for the concentration of sulfide and nonsulfide ores by front flotation.

Another object of the present invention is to provide improved reagents for use in the concentration by froth flotation of sulfide and nonsulfide ores, as well as nonmetalic minerals and the like.

Still another object of the present invention is to provide an improved method for introducing within a flotation pulp those reagents having a selective affinity for the metalliferous values of sulfide and nonsulfide ores and nonmetallic minerals and the like.

Other objects and advantages will become apparent as the invention is further disclosed.

PREFERRED EMBODIMENTS

The preferred compounds of the present invention correspond to the formula

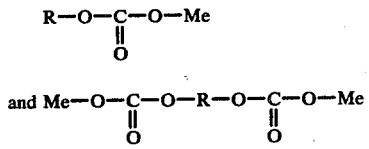

wherein Me is alkali metal or ammonia, and R represents a hydrocarbyl group selected from the group consisting of straight or branched alkyl containing up to 12 carbon atoms, alkaryl, aralkyl, aryl, cyclo, wherein the cyclic or cyclo group contain up to 12 carbon atoms. Said hydrocarbyl groups may contain a heteroatom substituted in the hydrocarbyl chain or structure, and is preferably selected from the group consisting of an —O— oxygen or a neutral carbonic group

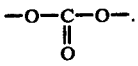

According to the invention alkyl or aryl bicarbonate or di-bicarbonate are provided and proved as flotation reagents. Despite of a great many varieties of said hydrocarbyl bicarbonates or di-bicarbonate they do not differ appreciably in their general habit and behavior, i.e., in collecting characteristics in froth flotation process of this invention, of which hydrocarbyl groups in said bicarbonates or di-bicarbonate several characteristic groups are presented hereinbelow.

I group of alkyl hydrocarbyl, wherein R in the general formula is selected from the straight or branched alkyls with 12 carbon atoms;

II group of aralkyl hydrocarbyl, wherein R in the general formula is selected from the group of ethoxybenzylmethyl, ethoxycresyl, ethoxybenzylhexamethyl, acetylcyclohexyl;

III group of alkaryl hydrocarbyl wherein R in the general formula is selected from the group of tolyl, xylyl, mesitylene, hexamethylbenzyl, cresyl;

IV group of aryl hydrocarbyl wherein R in the general formula is selected from the group of phenyl, diphenyl;

V group of cyclo hydrocarbyl wherein R in the general formula is selected from the group of cyclohexyl, dicyclohexyl, cyclobutyl carbinol, cyclohexyl carbinol, dicyclohexyl carbonate.

In all of these five groups of hydrocarbyl bicarbonates di-bicarbonate a great many of substitution are feasible, which cannot be enumerated herein.

The preferred embodiments with which the flotation invenstigations were fulfilled are the following:

Decyl bicarbonate
Dodecyl carbonate di-bicarbonate
Mesitylyl bicarbonate
Cresyl bicarbonate
Ethoxybenzylmethyl bicarbonate
Cyclohexyl bicarbonate
Cyclohexyl carbinol bicarbonate
Dicyclohexyl carbonate di-bicarbonate The hydrocarbyl bicarbonates and di-bicarbonates froth flotation compounds can be prepared by reacting of half molecular equivalent of an hydrocarbyl chloride, or chlorinated hydrocarbon with anhydrous soda ash in a dry solvent by gently heating, so that univalent hydrocarbyl bicarbonate, which ensues, acting as a bicarbonate is provided. The novel compounds can be employed to improve the flotation process in separating sulfide and oxide minerals of copper, silver, lead, zinc, nickel, cobalt also arsenides of nickel and cobalt, as well as the oxide minerals of magnesium, calcium, strontium, barium, iron, and manganese. The special feature as well as the special advantage which offer said novel collectors of hydrocarbyl bicarbonates or di-bicarbonates of this invention are: a cheap reagent is at hand for the beneficiation of iron oxide ore of chert character, silicified manganese ore, silicified magnesite and brucite ore, selective separation of copper sulfide minerals from molybdenite.

The novel compounds as defined herein have special utility as flotation collectors and can be employed in standard flotation processes to concentrate selectively copper mineral from molybdenite, wolframate, vanadate, and bismuth minerals if present in ore. The novel collectors are useful in concentrating of oxide and sulfide ores of copper, lead, and zinc; they are useful in beneficiation of magnesite and brucite because silica is unaffected by said collectors; calcite, barite, strontianite may be successfully recovered from their ores because alumino silicates are unaffected by these reagents. The Feasibility of the selective flotation of said metallic and nonmetallic minerals depends heavily on the matrix in which the recoverable mineral occurs, as well as of the complexity, i.e., of the natural mixture of several recoverable minerals in the respective ore. In such cases the depressors for certain minerals are to be added to the pulp of mineral slurry. The effective quantity of a flotation collector compound as defined herein, usually ranges from about 0.05 kg to about 0.5 kg, per ton of dry ore in the pulp. All the said metallic and nonmetallic minerals collect in the froth which is readily overflowed or skimmed off from the residual gangue and other nondesirable materials and the metal values therein not recovered, i.e., depressed, or not recoverable at all.

TESTS

To illustrate the invention 22 examples of the recovery of metallic and nonmetallic minerals from their ores are presented including those of magnesium, calcium, strontium, and barium minerals in the Table 1; those of copper, silver, lead, and zinc of the base matal minerals in the Table 2; those of nickel, cobalt, iron, and manganese minerals of heavy metal minerals in table 3. Said examples are accomplished by the application of the preferred embodiments disclosed hereinbefore.

The procedure in performing the laboratory examples for above enumerated ores was of the same manipulation as follows: 400 grams of the ore feed was sized by milling to pass 120 mesh standard sieve. Transfering the sized flotation feed in the 500 grams Denver lab. flotation machine, various amounts of above enumerated preferred embodiments of hydrocarbyl bicarbonate or di-bicarbonate for collecting purposes were added. Sodium silicate was added as dispersant of silica and the silicates despite that said collectors are highly selective and specific for hereinabove said ores and unaffect silica and the silicates. In certain cases a frother such as pine oil or methyl-iso-butyl carbinol was added to enhance the development of the froth. After the addition of the reagents, the pulp of mineral slurry was conditioned for three minutes. The amounts of added reagents are indicated in the accompanying tables. The rougher concentrates were skimmed from five to ten minutes, and were not cleaned or recleaned afterward, because the concentrates have shown sufficiently successful results, as well as because of small amounts of rougher concentrates for most of ore treated. The investigations at this point indicate that the faulty operating conditions were the very low densities under which the cleanings have to be performed, which produced great losses from produced concentrates to the cleaner tailing. So it become obvious that some thickening would have to be done before any successful treatment of this kind of cleaning and upgrading could be devised, which, obviously, could be done only on a large scale.

In Example 9, very fine diseminated native silver, was floated in a 50 grams flotation cell with ethoxybenzylhexamethyl bicarbonate with successful results, which was estimated by microscopic count.

In Example 21, a complex copper-pyrite-molybdenite ore was investigated. To float the chalcopyrite in presence of pyrite, potassium cyanide was added to depress pyrite while molybdenite was unaffected by the reagent used.

In Example 22, a complex copper-zinc-pyrite ore was investigated. To float chalcopyrite in the presence of sphalerite and pyrite, potassium cyanide was added, which depressed both minerals. After copper flotation, iron trichloride or iron sulfate was added to block cyanide at the surface of sphalerite and dereagentise the zinc mineral. By this manipulation zinc material the sphalerite was floated by the same collector in the presence of pyrite, because pyrite was unaffected and left depressed.

All other flotation of investigated minerals were simple and responsive to the reagent used, while all of the various gangue material were unaffected by the used reagent, the hydrocarbyl bicarbonates or di-bicarbonates.

TABLE 1

FLOTATION OF EARTH ALKALINE METAL MINERALS

| Ore treated | Collector grams per ton | Feed % | Conc. % | Recovery % |
|---|---|---|---|---|
| Example 1 | Dihexyl-carbonate bicarbonate | % Mg | % Mg | % |
| Magnesite | 250 g per ton | 22.4 | 28.0 | 92.1 |
| Example 2 | Dihexyl-carbonate di-bicarbonate | % MgO | % MgO | % |
| Brucite | 250 g per ton | 19.1 | 68.1 | 90.3 |
| Example 3 | Decyl bicarbonate | % CaO | % CaO | % |
| Calcite | 280 g per ton | 24.0 | 55.2 | 94.5 |
| Example 4 | Decyl bicarbonate | % Sr | % Sr | % |
| Strontianite | 200 g per ton | 16.4 | 56.8 | 88.6 |
| Example 5 | Decyl bicarbonate | % BaO | % BaO | % |
| Barite | 500 g per ton | 28.1 | 63.8 | 82.4 |

TABLE 2

FLOTATION OF BASE METAL MINERALS

| Ore treated | Collector grams per ton | Assay of the products Feed | Conc. | Recovery |
|---|---|---|---|---|
| Example 6 | Mesitylyl bicarbobate | % Cu | % Cu | % |
| Chalcopyrite | 30 g per ton | 2.8 | 22.6 | 87.6 |
| Example 7 | Ethoxybenzylmethyl bicarbonate | % Cu | % Cu | % |
| Chrisocolla | 25 g per ton | 1.9 | 27.1 | 91.2 |
| Example 8 | Cresyl bicarbonate | % Cu | % Cu | % |
| Malachite | 60 g per ton | 3.8 | 35.2 | 94.4 |
| Example 9 Native silver ore | Ethoxybenzylmethyl bicarbonate the reagent was added dropwise | The recovery was estimated by microscopic count at about 90 percent. | | |
| Example 10 | Ethoxybenzylmethyl bicarbonate | % Pb | % Pb | % |
| Galena | 100 g per ton | 8.6 | 69.5 | 92.1 |
| Example 11 | Didecyl-carbonate di-bicarbonate | % Pb | % Pb | % |
| Cerusite | 150 g per ton | 11.3 | 61.4 | 91.9 |
| Example 12 | Cyclohexyl bicarbonate | % Zn | % Zn | % |
| Sphaierite | 125 g per ton | 9.2 | 57.8 | 90.4 |
| Example 13 | Ethoxybenzylmethyl bicarbonate | % Zn | % Zn | % |
| Smitsonite | 100 g per ton | 7.6 | 45.2 | 91.0 |
| Example 14 | Ethoxybenzylhexamethyl bicarbonate | % Zn | % Zn | % |
| Calamine | 100 g per ton | 6.9 | 51.3 | 86.4 |

TABLE 3

FLOTATION OF HEAVY METAL MINERALS

| | | | | |
|---|---|---|---|---|
| Example 15 | Ethoxybenzylhexamethyl bicarbonate | % Ni | % Ni | % |
| Milllerite | 20 g per ton | 1.4 | 48.2 | 81.6 |
| Example 16 | Ethoxybenzylmethyl bicarbonate | % Co | % Co | % |
| Smaltite | 25 g per ton | 1.5 | 21.3 | 86.5 |
| Example 17 | Didecyl-carbonate di-bicarbonate | % Fe | % Fe | % |
| Hematite | 500 g per ton | 32.1 | 61.4 | 82.4 |
| Example 18 | Cyclohexyl bicarbonate | % Fe | % Fe | % |
| Siderite | 300 g per ton | 22.2 | 43.8 | 89.6 |
| Example 19 | Dicyclohexyl-carbonate di-bicarbonate | % Mn | % Mn | % |
| Rhodochrosite | 250 g per ton | 18.4 | 53.3 | 90.6 |
| Example 20 | Dicyclohexyl-carbonate di-bicarbonate | % Mn | % Mn | % |
| Psilomelane | 400 g per ton | 24.8 | 52.6 | 89.4 |
| Example 21 | Dicyclohexyl-carbonate di-bicarbonate | % Cu | % Cu | % |
| Chalcopyrite | 30 g per ton | 1.8 | 24.2 | 88.6 |
| Molydbenite | | % Mo | % Mo | % |
| /Pyrite/ | | 0.4 | trace | — |
| Example 22 | Ethoxybenzylhexamethyl bicarbonate | % Cu | % Cu | % |
| Chalcopyrite | 40 g per ton | 2.1 | 21.3 | 89.0 |
| Sphalerite | | % Zn | % Zn | |
| /Pyrite/ | 6.4 | 0.08 | — | |

The froth flotation of the present invention is carried out in accordance with good flotation practice and usually, though not always, involves flotation in rougher cells, followed by one or more cleanings of the rougher concentrate. The reagents are effective in small amount and the promotion is sufficiently persistent so that it is feasible to carry out the rougher and cleaner flotation with a single addition of reagents at the beginning of the operation. On the other hand, it is sometimes advantageous to use stage additions of reagents. Pulp densities are in general the same as in other applications of froth flotation practice, i.e., about 15 to 30 percent of solids by weight.

The flotation plant practice by serving the alkyl, alkaryl, aralkyl, aryl and cycloalkyl alkali or ammonium bicarbonates or di-bicarbonates for the recovery of metal values, i.e., floating the aforesaid minerals of magnesium, calcium, strontium, barium, copper, silver, lead, zinc, nickel, cobalt iron, and manganese, the ore is crushed and sized by milling to at least about 120 mesh standard sieve, which depends on the particular ore treated. Milling to finer sizes is preferable. After this step the sized ore is pulped and as a mineral slurry is ready for the treatment in the flotation plant equipment, i.e., by passing through the conditioner where the collector and the auxiliary reagents such as depressor, dispersant and the like are added if needed. From the conditioner the pulp is pumped in the receiving box of the first stage or the main flotation bank. In the receiving box of the main bank some frother is added if needed. In the main flotation bank the froth produced by agitation is skimmed or is overflowed in the usual manner. In most cases it is advantageous to use multiple stage flotation processes to treat the underflow or partially metal value barren pulp to increase the degree of separation or to enhance the grade of recovery. Also, the use of varying amounts of emulsifiers, dispercsants, and depressants, and the like substances in different stages may be used to advantage to obtain the highest yield and the best separation.

Having disclosed the novel collectors of this invention as well as the handling of the mineral slurry, I have to say the final object of this invention is to provide a method for the flotation recovery of minerals consisting of magnesium, calcium, strontium, barium, copper, silver, lead, zinc, nickel, cobalt, iron and manganese.

From the foregoing, it will be seen that this invention is one well adapted to attain all of the ends and objects hereinbefore set forth, thogether with other disadvantages which are obvious and which are inherent to the process and method.

It will be understood that certain features and subcombinations are of utility and may be employed without reference to other features and subcombinations. This is contemplated by and is within the scope of the claims.

The invention having been described, what is claimed is:

1. A method of beneficiating ores selected from the group of earth alkaline metal carbonates and sulfates of magnesium calcium, strontium, and barium, also ores selected from the group of base metal carbonates, silicates, sulfates, sulfides, of copper, silver, lead, and zinc, as well as ores selected from the group of heavy metal oxides, carbonates, sulfides, arsenides of nickel, cobalt, oxides, carbonates of iron, and manganese by froth flotation process to produce a froth concentrate of desired metal value leaving gangue minerals, such as silica and the alumino silicates in tailing which comprises; effecting the froth flotation of the said metalic ores and nonmetallic minerals by means of alkali or ammonium salts of alkyl, alkaryl, aralkyl, aryl, cyclo, cycloalkyl bicarbonates or di-bicarbonates as promoter-collectors, which make collecting and floating the desired metal values at a pH value of the flotation circuit from 6 to 8; said hydrocarbyl bicarbonates forming mineral-hydrocarbon complexes which form bubbles provided by agitating the pulp of mineral slurry in the presence of air; and recovering a froth concentrate relatively rich in the desired metal value, leaving tailing relatively poor in the desired metal value.

2. A method according to claim 1, in which said collector is a hydrocarbyl bicarbonate of which the general formula is $$R-O-\underset{\underset{O}{\|}}{C}-O-Me$$

wherein Me is alkali metal or ammonia, and R is selected from the group of straight or branched alkyl chain with up to 12 carbon atoms; or R is selected from the group represented by ethoxybenzylmethyl, ethoxybenzylhexamethyl, ethoxycresyl; or R is selected from the group represented by tolyl, xylyl, mesitylenyl, hexamethylbenzyl; or R is selected from the group represented by phenyl, diphenyl, cresyl; or R is selected from the group represented by cyclohexyl, dicyclohexyl, cyclohexyl carbinol, acetylcyclohexyl; said hydrocarbyl groups or structures may contain a heteroatom substituted in the hydrocarbon chain or structure, and is selected from the group consisting of an —O— oxygen, or a neutral carbonic group $$-O-\underset{\underset{O}{\|}}{C}-O-;$$

said substituted cyclic and cyclo structure have no more than 12 carbon atoms.

3. A method according to claim 1, in which said collector is hydrocarbyl di-bicarbonate of which the general formula is $$Me-O-\underset{\underset{O}{\|}}{C}-O-R-O-\underset{\underset{O}{\|}}{C}-O-Me$$

wherein Me is alkali metal or ammonia, and R is selected from the group of straight or branched alkyl chain with up to 12 carbon atoms, or R is selected from the group of phenyl, diphenyl, dipropoxyphenyl, cyclohexane, dipropoxycyclohexane, dihexyl-carbonate, diphenyl-carbonate, dicyclohexyl-carbonate; said substituted cyclic or cyclo structures have no more than 12 carbon atoms; said hydrocarbyl groups may contain a heteroatom substituted in the hydrocarbon chain or structure, and is selected from the group of —O—oxygen, or a neutral carbonic group $$-O-\underset{\underset{O}{\|}}{C}-O-.$$

* * * * *